United States Patent [19]

Zayarny et al.

[11] Patent Number: 5,046,430

[45] Date of Patent: Sep. 10, 1991

[54] TAMPING MECHANISM OF TIE-TAMPING OUTFIT

[75] Inventors: Sergei L. Zayarny; Vladimir S. Notkin; Alexei A. Ilyashenko, all of Kaluga, U.S.S.R.

[73] Assignee: Kaluzhskoe Proizvodstvennoe Obiedinenie Putevykh Mashin I Gidrapriuodok "Kalugaputmash", Kaluga, U.S.S.R.

[21] Appl. No.: 477,846

[22] PCT Filed: Jun. 23, 1989

[86] PCT No.: PCT/SU89/00170

§ 371 Date: Feb. 21, 1990

§ 102(e) Date: Feb. 21, 1990

[87] PCT Pub. No.: WO89/12718

PCT Pub. Date: Dec. 28, 1989

[30] Foreign Application Priority Data

Jun. 24, 1988 [SU] U.S.S.R. ..... 4484168

[51] Int. Cl.[5] ..... E01B 27/16

[52] U.S. Cl. ..... 104/12

[58] Field of Search ..... 104/10, 12, 13, 14; 81/463; 173/116, 128, 103, 118

[56] References Cited

U.S. PATENT DOCUMENTS

| | | | |
|---|---|---|---|
| Re. 27,604 | 3/1973 | Stewart et al. | 104/12 |
| 1,415,194 | 5/1922 | Robinson | 104/12 |
| 2,303,245 | 11/1942 | Weyandt | 104/12 |
| 3,426,697 | 2/1969 | Steward | 104/12 |
| 3,605,626 | 9/1971 | Stewart | 104/12 |
| 3,981,247 | 9/1976 | Theurer | 104/12 |

FOREIGN PATENT DOCUMENTS

| | | | |
|---|---|---|---|
| 0901333 | 5/1963 | France | 104/12 |
| 0601969 | 2/1960 | Italy | 104/12 |
| 1013533 | 4/1975 | U.S.S.R. . | |
| 629896 | 8/1978 | U.S.S.R. . | |

*Primary Examiner*—Robert J. Oberleitner
*Assistant Examiner*—Mark T. Le
*Attorney, Agent, or Firm*—Fleit, Jacobson, Cohn, Price, Holman & Stern

[57] ABSTRACT

This invention relates to a tamping mechanism of a tie-tamping outfit used in road-building. The tamping mechanism of the tie-tamping outfit includes a casing mounting at least two vibrators rigidly linked with tamping tools. Each vibrator has at least one tubular spring having a space which communicates with a hydraulic source of vibration excitation. The invention can be used for compacting a railway bed during repair and laying of rail tracks.

3 Claims, 4 Drawing Sheets

TAMPING MECHANISM OF TIE-TAMPING OUTFIT

BACKGROUND OF THE INVENTION

1 . Field of Invention

This invention relates to the field of road-building and, particularly, to a tamping mechanism of a tie-tamping outfit.

2 . Description of Related Art

Known in the prior art is a tie-tamper (See, e.g., U.S.S.R. publication 629896), comprising a tamping mechanism with a casing mounted on which are tamping tools, hydraulic pumps and hydraulic cylinders articulated to the casing, and a valve unit.

In this known tie-tamping process the tamping tools are moved relative to one another in a longitudinal direction by hydraulic cylinders. The valve unit installed between the hydraulic pumps and hydraulic cylinders transforms the flow of the service fluid into a pulsating flow which ensures the progressive vibratory motion of the tamping tools.

This tamping mechanism is noted for a low effect of vibratory action since it makes no use of hydraulic recoil so that at the end of each hydraulic action part of the service fluid returns through the hydraulic control valve into the tank which calls for utilizing full power of the drive for each following vibrating action. The use of hydraulic cylinders in the capacity of vibrators also impairs the efficiency of the drive due to overflows of the service fluid inside the drive.

Another know tie-tamping machine (See U.S.S.R. publications 1013533) comprises tamping mechanisms mounted on a frame with a provision for being lifted and lowered by a drive, each mechanism comprising a casing with the tamping tools mounted on it and connected with vibrators constituted by hydraulic cylinders. Besides, the tamping mechanism has a hydraulic source of vibration excitation comprising distributing blocks and arresters. The vibrators are rigidly secured on the tamping tool with a provision for horizontal movement while the arresters are installed on the tamping mechanism and linked with an additional hydraulic cylinder.

The tamping mechanism functions as follows. Being acted upon by the vibrator, the tamping tool moves horizontally, the amplitude of this movement being limited by the arresters fixed relative to the casing by the additional hydraulic cylinder. After the tamping tool has penetrated into the ballast, the limiting arresters are displaced by the additional hydraulic cylinder relative to the casing which causes displacement of the central position of the tamping tool while retaining its vibratory displacement from one arrester to the other. This provides for vibratory movement of the tamping tool combined with its displacement in a horizontal plane which ensures compaction of the ballast under the tie.

Thus, the vibratory movement of the tamping tool is ensured by a complicated hydromechanical mechanism comprising a large number of elements of the start-control hydraulic apparatus, and this limits the vibration frequency of the tamping tool and impairs the effect of vibrating action. This requires periodical accelerations and stopping of the tamping tool in extreme positions. The necessity for overcoming the inertia of the tamping tool brings about additional expenditures of power, thus reducing the efficiency of the tamping mechanism. The efficiency of vibrators realized in the form of hydraulic cylinders is limited also by overflows of the service fluid inside the hydraulic cylinders, the extent of the overflows growing in service which curtails the service life of the drive.

Thus, the know mechanism fails to ensure efficient compaction of ballast under the railway ties.

SUMMARY OF THE INVENTION

The main object of the invention is to develop a tamping mechanism of the tie-tamping outfit whose design would ensure efficient compaction of the railway bed ballast by raising the frequency of hydraulic effects applied to it.

This object is achieved by providing a tamping mechanism of the tie-tamping outfit comprising a casing mounting at least two vibrators rigidly linked with tamping tools, each vibrator communicating with a hydraulic source of vibration excitation. The casing is mounted on a frame with a provision for being moved vertically by a drive wherein, according to the invention, each vibrator has the form of at least one tubular spring whose space is in communication with a hydraulic source of vibration excitation.

It is also practicable to have the tamping mechanism of the tie-tamping outfit, in which each vibrator is made in the form of two tubular springs, include springs which are rigidly interconnected at one end and articulated to the casing, while one of the opposite ends of each spring is rigidly linked to the tamping tool and the other opposite end of the other tubular spring is articulated to the casing via a hydraulic cylinder.

The tamping mechanism of a tie-tamping outfit realized as described above permits:

raising the vibration frequency of the tamping tool; and using the dynamic properties of vibrators in the form of tubular springs for exciting forced mechanical vibrations therein.

It is practicable that in the tamping mechanism of the tie-tamping outfit the hydraulic source of vibration excitation should take the form of two gear pumps whose gears are provided with ports for putting in communication periodically the suction and pressure spaces, respectively, so that the suction spaces of each gear pump are in communication with the respective space of the tubular spring while the pressure spaces of each gear pump communicate with each other.

This will raise efficiency of the hydraulic source of vibration excitation by utilizing the phenomenon of hydraulic recoil.

BRIEF DESCRIPTION OF THE DRAWINGS

Now the invention will be described by way of examples with reference to the accompanying drawings in which.

DETAILED DESCRIPTION OF THE PREFERRED EMBODIMENTS

Figure 1:
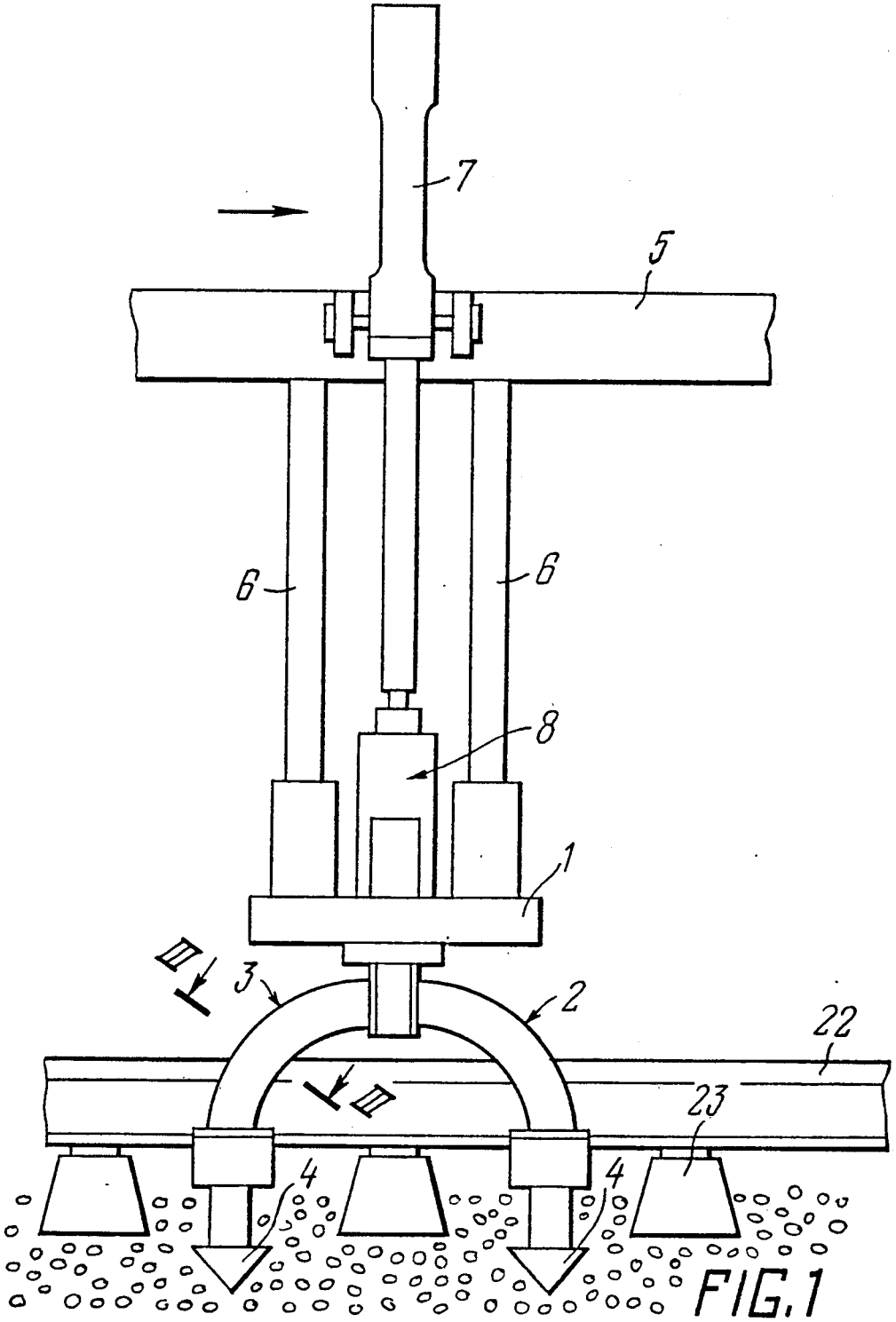
FIG. 1 is a general view of a version of the tamping mechanism of the tie-tamping outfit according to the invention.

The tamping mechanism of the tie-tamping outfit in the version illustrated in FIG. 1 comprises a casing 1, mounting two vibrators 2 and 3. Each vibrator 2 and 3 is rigidly linked with tamping tools 4. The casing 1 is mounted on the frame 5 resting on a bogie (not shown in the drawing) with a provision for being moved vertically over the guides 6 by a drive 7. The drive 7 may be constituted by a hydraulic cylinder. In the given embodiment each vibrator 2 and 3 has the form of one tubular spring whose space communicates with a hydraulic source 8 of vibration excitation.

Figure 2:
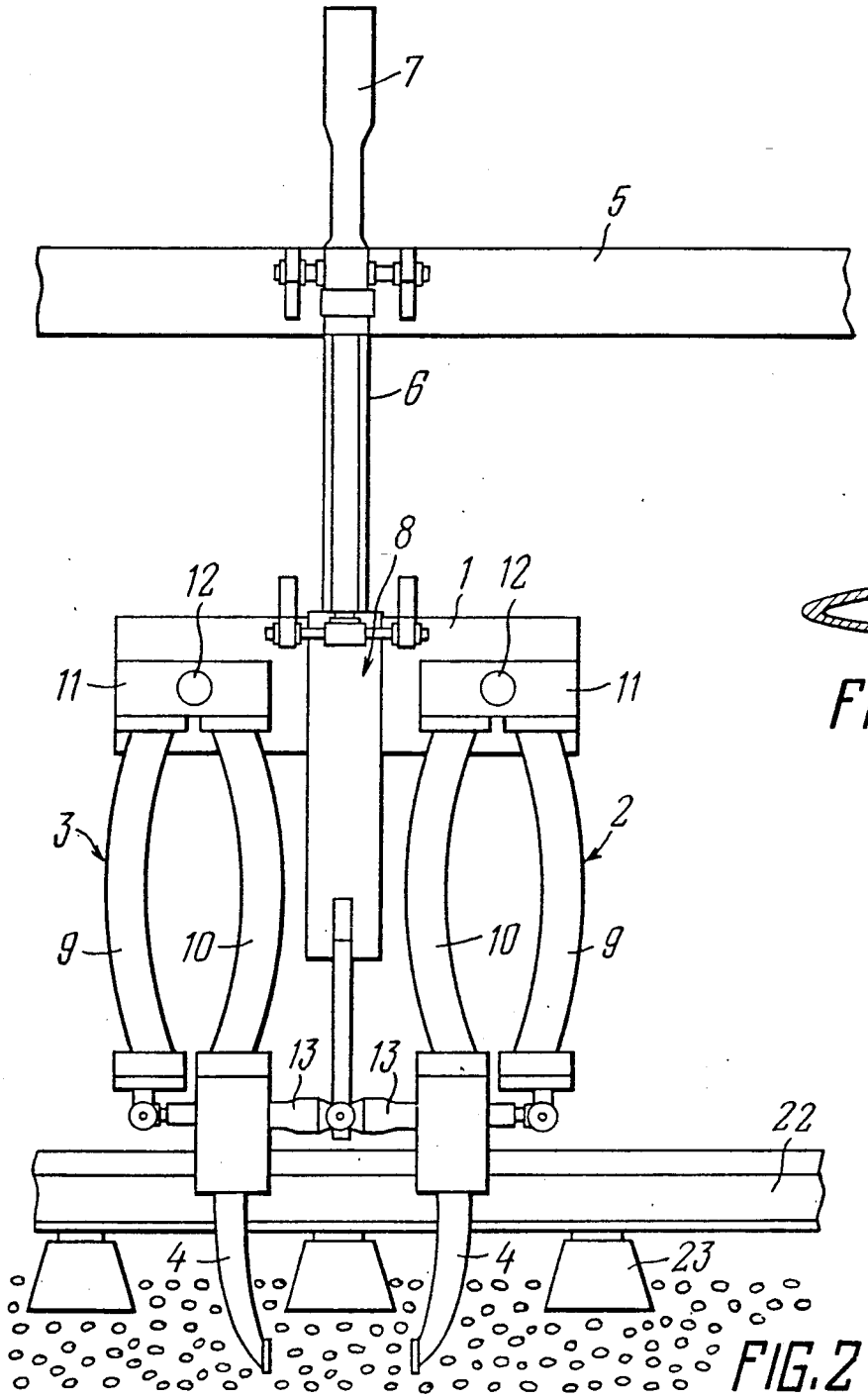
FIG. 2 is another version of the same, according to the invention.
Figure 3:
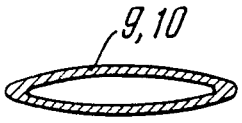
FIG. 3 is a sectional view as seen along line III—III in FIG. 1.

In another embodiment shown in FIG. 2, the tamping mechanism of the tie-tamping outfit is constructed such that each vibrator 2 and 3 is made, respectively, in the form of two tubular springs 9 and 10. The tubular springs 9 and 10 are rigidly connected at one end by a plate 11 with each other and are pivotably connected by a hinge 12 with the casing 1 while one of the opposite ends of the tubular spring 10 is rigidly connected to the tamping tool 4 while the other opposite end of the tubular spring 9 is articulated with the casing 1 via the hydraulic cylinder 13.

Figure 4:
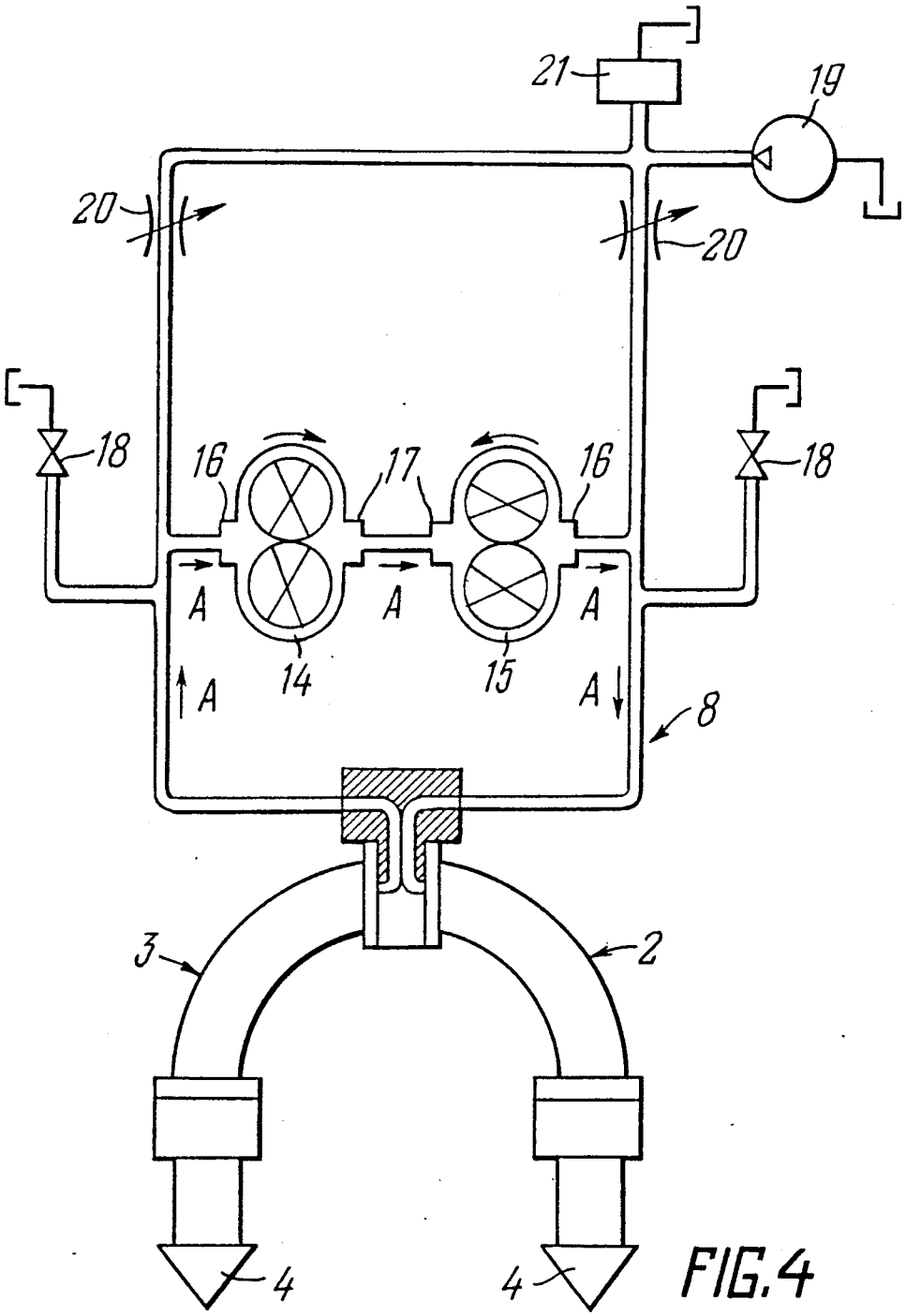
FIG. 4 is a schematic diagram of the hydraulic source of vibration excitation with the tamping mechanism of the tie-tamping outfit, in one version of realization.

The hydraulic source 8 (FIG. 4) of vibration excitation is made in the form of two gear pumps 14, 15 whose gears have ports in the teeth for periodical communication of the suction and pressure spaces 16, 17, respectively. The suction spaces 16 of each gear pump 14, 15 communicate with the corresponding space of the tubular spring (vibrators 2 and 3), and the pressure spaces 17 of each gear pump 14, 15 communicate with each other.

Besides, the hydraulic system has air vent cocks 18 communicating with the spaces of tubular springs (vibrators 2, 3). To make up for the losses of the service fluid due to probable leaks there is a small pump 19 which replenishes the internal spaces of the tubular springs through adjustable throttles 20. The throttles 20 are also required for adjusting the hydraulic system. The pressure regulator 21 maintains an average pressure in the hydraulic system.

Figure 5:
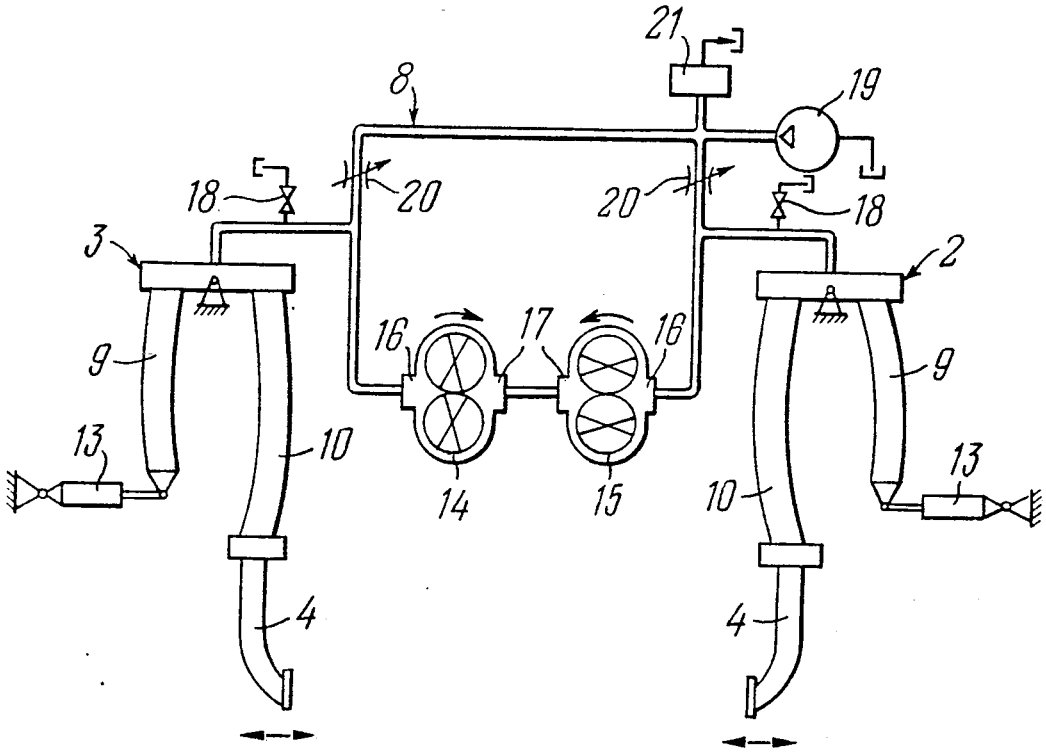
FIG. 5 is the same, in another version of realization.

In other embodiment of the tamping mechanism of the tie-tamping outfit shown in FIG. 5, when each vibrator 2, 3 consists of two tubular springs 9, 10 the suction spaces 16 of each gear pump 14, 15 communicate with the respective spaces of the tubular springs 9, 10 while their pressure spaces 17 are in communication with each other.

The purpose of the other hydraulic system elements shown in FIG. 5 is similar to that considered above.

The damping mechanism of the tie-tamping outfit functions as follows. On arrival of the tie-tamping outfit over the rail track 22 (FIG. 1) to the operating site, the tamping mechanism is installed with its tamping tools 4 arranged symmetrically with relation to ties 23 whose ballast bed has to be compacted. The position of the tamping mechanism with relation to the ties 23 is fixed by a braking device (not shown in the drawing). The control system (not shown in the drawing) sends a command signal to turn on the hydraulic source 8 of vibration excitation.

The internal spaces of the tubular springs (vibrators 2, 3) are fed with pulsating pressure. Under the effect of this pressure the tubular springs are deformed and there appear induced mechanical vibrations of their free ends carrying the tamping tools 4. The vibration intensity is set by the operator who changes the pulsation frequency of the hydraulic source 8 of vibration excitation. Then the control system gives a command for starting the drive 7 and the casing 1 of the tamping mechanism goes down over the guides 6. The vibrating tamping tool 4 penetrates into ballast between the ties 23. As the tamping tool goes deeper it forces some ballast from between the ties, the volume of said ballast being equal to the volume of the tamping tool 4. The forced-out ballast fills up the hollow spaces under the ties 23 of the rail track 22. The degree of ballast compaction is adjusted by the operator in response to the penetration depth of the tamping tool 4 into ballast. After compacting the ballast, the tamping mechanism is lifted to the initial position in which the hydraulic source 8 of vibration excitation is turned off to save energy. Then the tie-tamping outfit rolls to the next ties 23 requiring the tamping of ballast. The tamping tool 4 is again installed symmetrically relative to the ties 23 and the process is repeated again as described above.

According to another embodiment (FIG. 2), the tamping mechanism of the tie-tamping outfit operates on the similar lines with the one described above. However, in this embodiment, each vibrator 2, 3 is made in the form of two tubular springs 9, 10 so that the functioning of the tamping mechanism is characterized by the following peculiar features. Under the effect of pulsating pressure, the tubular springs 9, 10 are subjected to deformations and induced mechanical vibrations. With the aid of the hinge 12 they are summed up on the tamping tool 4. After the tamping tool 4 has penetrated into ballast, the hydraulic cylinders 13 are turned on. Being moved by the hydraulic cylinder 13 relative to the hinge 12, the vibrators 2, 3 functioning as a lever provide for the longitudinal displacement of the vibrating tamping tool 4. The vibration of the tamping tool 4 combined with its longitudinal displacement ensures vibratory displacement of ballast under the tie 23.

Thus, development of forced mechanical vibrations of the vibrators 2, 3 at the necessary frequency allows their dynamic properties to be used to promote the efficiency of the tamping mechanism.

Besides, the design of the vibrators 2, 3 brings to a minimum losses therein which are caused in the given example mainly by the internal friction in the material of the tubular springs and by compressibility of liquid which raises the efficiency of the tamping mechanism.

The increased efficiency of the tamping mechanism and a higher frequency of vibrating effects improves considerably the interaction of the tamping tool 4 with ballast which tells favourably on mutual displacements of its particles, improves the standard of railway bed tamping and the positional stability of the mechanism in action. On completion of vibratory compaction of ballast under the tie 23, the return stroke of the hydraulic cylinder 13 brings back the tamping tool 4 to the initial position. In the embodiment being considered the hydraulic cylinder 13 does not serve as a source of hydraulic vibration excitation being used exclusively to ensure a constant component of the longitudinal movement of the tamping tool 4. This division of functions between the hydraulic cylinder 13 and vibrators 2, 3 in the form of tubular springs 9, 10 raises the efficiency of vibrating effect applied by the tamping tool 4 to the ballast and, as a consequence, improves the quality of railway bed tamping.

The pulsating pressure is built up by a hydraulic source 8 (FIG. 4) of vibration excitation.

Two gear pumps 14, 15 work in synchronism at a present phase shift. Within one revolution the pumps deliver the service fluid several times through the ports of the gears into the pressure space 17 and put said pressure space 17 several times in communication with the suction space 16. The cross-hatched segments correspond to the portions of gears with continuous teeth while the nonhatched segments correspond to the portions of gears with ports in the teeth. The direction of surface fluid flow in the gears of the pumps 14, 15 is shown by arrows A. The service fluid is forced by the pump 14 from the space of the tubular spring of the vibrator 3 through the ports of the pump 15 into the space of the tubular spring of the vibrator 2. After the gears of the pumps 14, 15 have turned through ¼ of a revolution the fluid pressure in the tubular spring of the vibrator 3 comes to a minimum while its pressure in the tubular spring of the vibrator 2 reaches a maximum. The ports of the pump 15 close and those of the pump 14 open. Rotating further, the pump 15 forces the service fluid from the space of the tubular spring of the vibrator 2 through the open ports of the pump 14 into the space of the tubular spring of the vibrator 3. In this case the surface fluid moves in the direction contrary to that shown by arrows.A. Rotating further, the pumps 14, 15 come to the initial position and the process is repeated over again. During operation of the hydraulic source 8 of vibration excitation the pressure regulator 21 after the pump 19 maintains an average controlled fluid pressure in the spaces of the tubular springs of the vibrators 2, 3. In case of fluid leaks in the hydraulic source 8 of vibration excitation and dropping of the average pressure level in the spaces of the tubular spring of the vibrators 2, 3 the lost amount of fluid is replenished by the pump 19 through the throttles 20.

Thus, there is a closed circuit for circulation of the service fluid. This circuit is made up of the tubular spring of the vibrator 3, pump 14, pump 15 and the tubular spring of the vibrator 2. Drainage of the service fluid from the closed circuit in the course of operation is not envisaged (except for probable minor leaks). This rules out the losses of energy required for returning the fluid into the tank and utilizes the effect of hydraulic recoil while pumping the fluid from one tubular spring to the other which produces a positive effect on vibration of the tamping tools 4.

The hydraulic source 8 (FIG. 5) of vibration excitation functions similarly in the tamping mechanism of the tie-tamping outfit in which each vibrator 2, 3 consists of two tubular springs 9, 10.

Thus, the above-described tamping mechanism of the tie-tamping outfit utilizes the dynamic properties of vibrators which is manifested in the development of forced mechanical vibrations of the tamping tool at minimum losses, permits reducing the losses of energy in the hydraulic source of vibration excitation and, as a result, contributes to a radical improvement of tamping the ballast of the railway bed and raising its stability in service.

INDUSTRIAL APPLICABILITY

The invention can be used for tamping the railway ballast bed in the course of repairs and laying of rail tracks in railway building, on other construction jobs, and in the mining industry.

We claim:

1. A tamping mechanism for a tie-tamping outfit, comprising:

a casing;

at least two vibrators rigidly linked mounted on said casing;

tamping tools rigidly linked to said vibrators, each vibrator communicating with a hydraulic source of vibration excitation;

a drive for moving said frame vertically, each vibrator being in the form of at least one tubular spring having an internal space which communicates with the hydraulic source of vibration excitation.

2. A tamping mechanism according to claim 1, wherein each vibrator includes two tubular springs, said tamping mechanism further comprising a hinge for rigidly interconnecting each of said tubular springs at one end to the casing, the other end of one of the two tubular springs being rigidly linked with the tamping tool, and the other end of the other of the tubular springs being articulated to the casing via a hydraulic cylinder.

3. A tamping mechanism according to claim 1, wherein the hydraulic source of vibration excitation has the form of two gear pumps, each of said gear pumps having gears provided with ports which periodically communicate a suction space and a pressure space thereof, the suction space of each gear pump communicating with the internal space of the at least one tubular spring, the pressure space of each gear pump communicating with the pressure space of the other gear pump.

* * * * *